United States Patent [19]

Kobler

[11] 4,013,331

[45] Mar. 22, 1977

[54] ELECTRICAL HOUSING MEMBER

[75] Inventor: Robert James Kobler, Winston-Salem, N.C.

[73] Assignee: AMP Incorporated, Harrisburg, Pa.

[22] Filed: Apr. 2, 1976

[21] Appl. No.: 672,929

Related U.S. Application Data

[60] Division of Ser. No. 520,572, Nov. 4, 1974, Pat. No. 3,971,613, which is a continuation of Ser. No. 572,589, Aug. 15, 1966.

[52] U.S. Cl. ..... 339/59 R

[51] Int. Cl.[2] ..... H01R 13/48

[58] Field of Search ..... 339/59–61, 339/217

[56] References Cited

UNITED STATES PATENTS

| | | | |
|---|---|---|---|
| 3,012,159 | 12/1961 | Druesedow | 339/59 M |
| 3,101,229 | 8/1963 | Yopp | 339/217 R |
| 3,165,369 | 1/1965 | Maston | 339/217 S |
| 3,440,596 | 4/1969 | Frompovicz | 339/59 M |

*Primary Examiner*—Joseph H. McGlynn
*Attorney, Agent, or Firm*—William J. Keating; Jay L. Seitchik; Frederick W. Raring

[57] ABSTRACT

An electrical connector housing for securing an electrical terminal in a passageway thereof, the passageway includes a first stop means integrally formed from a first area of the passageway and against which a section of the terminal engages to limit movement of the terminal in one direction in the passageway and a second stop means integrally formed from a second area of the passageway and being spaced from the first stop means, the second stop means defining stiffly-flexible means provided with free end means engageable with another section of the terminal thereby limiting movement of the terminal in another direction in the passageway.

2 Claims, 17 Drawing Figures

ELECTRICAL HOUSING MEMBER

CROSS REFERENCE TO RELATED APPLICATION

This application is a division of U.S. Pat. application Ser. No. 520,572, filed Nov. 4, 1974, now U.S. Pat. No. 3,971,613, which is a continuation of U.S. patent application Ser. No. 572,589, filed Aug. 15, 1966.

This invention relates to electrical housing members and more particularly to electrical housing members having integral latch means to removably latch electrical terminals therein.

In order to secure an electrical terminal in a passageway of a housing, the general approach is to stamp out a resilient lance member from a section of the electrical terminal which mates with an abutting surface in the passageway of the housing. The lance member is prone to damage during handling of the terminal and also if the terminal is in strip form on a reel because the lance can be moved to a position that would require it being pushed to its proper operative position. Stamping a lance member in a terminal increases the cost of the dies to make the terminal as well as increasing the cost of the terminal. Moreover, it would be desirable to provide a standard terminal because some applications do not require a lance member.

An object of the invention is to provide a dielectric housing member in which an electrical terminal is secured thereby.

Another object of the invention is the provision of a housing member having an integral stiffly flexible member in a passageway in the housing member to engage an electrical terminal to secure the electrical terminal therein.

A further object of the invention is to provide a housing member having stop means at an entrance of a passageway to limit movement of an electrical terminal in one direction and a stiffly flexible member in the passageway to engage the terminal to limit movement of the terminal in a direction opposite to the one direction.

An additional object of the invention is the provision of a housing member having a passageway provided with means to limit movement of an electrical terminal in both directions within the passageway and means to bias the electrical terminal in alignment with the means to limit movement of the terminal in one direction.

A still further object of the invention is to provide a terminal housing member having spaced stop means therein to secure an electrical terminal therein and the stop means are not susceptible to any damage.

Other objects and attainments of the present invention will become apparent to those skilled in the art upon a reading of the following detailed description when taken in conjunction with the drawings in which there are shown and described illustrative embodiments of the invention; it is to be understood, however, that these embodiments are not intended to be exhaustive nor limiting of the invention but are given for the purposes of illustration in order that others skilled in the art may fully understand the invention and the principles thereof and the manner of applying it in practical use so that they may modify it in various forms, each as may be best suited to the conditions of a particular use.

The foregoing and other objects are achieved by a preferred embodiment of an electrical connector assembly comprising a dielectric housing and an electrical terminal, the dielectric housing having at least one passageway extending therethrough, first stop means located adjacent one end of the passageway and second stop means integrally extending outwardly from a surface of the passageway and spaced from the first stop means, the electrical terminal having a contact section with one end disposed adjacent the first stop means to limit movement of the electrical terminal in one direction, the second stop means defining a stiffly-flexible member directed toward the first stop means and having one end engaging another end of the contact section to bias the terminal toward another surface opposite the first-mentioned surface of the passageway and another end about which the stiffly-flexible member flexes, the second stop means limiting movement of the electrical terminal in a direction opposite to the one direction.

Figure 1:
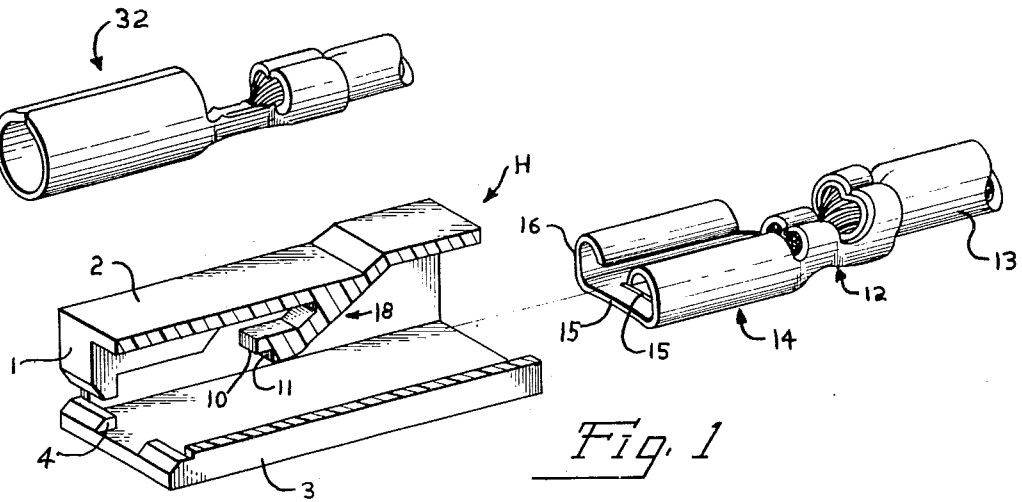
FIG. 1 is an exploded, perspective and partially sectioned view of a housing member and an electrical terminal securable therein.

Turning now to the drawings and especially FIGS. 1 through 6, a housing member H is illustrated which is made from any suitable dielectric material in accordance with conventional molding techniques preferably of the straight-action, injection-molding type. The dielectric material from which the housing member is made has stiffly-flexible characteristics and is preferably nylon or the like. The front of the housing member has inwardly directed sections 1 extending outwardly from top section 2 of the housing member toward bottom section 3. Inwardly-directed sections 4 extend outwardly from bottom section 3 toward top section 2 and sections 1 and 4 are in alignment with each other. The inner ends of sections 1 and 4 are spaced from each other to define an entrance 5 for housing member H. The outer surface of sections 1 and 4 at entrance 5 are beveled to facilitate the insertion of an electrical terminal member of the tab type within entrance 5.

Figure 2:
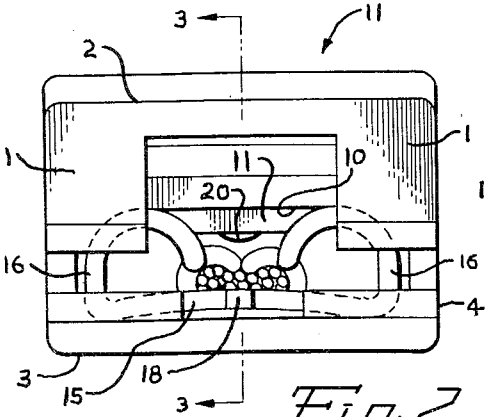
FIG. 2 is a front elevational view of an electrical housing member with an electrical terminal in place therein.

As can be discerned from FIGS. 1 and 2, sections 1 and sections 4 are spaced from each other and do not extend across the front of the housing member. Sections 1 and 4 extend inwardly from side section 6 and top and bottom sections 2 and 3. Entrance 5 is in communication with a passageway 7 which extends through housing member H. Passageway 7 is slightly larger in cross section at its rear end to accommodate conductor members of different diameters.

An integral projection 8 extends outwardly from an inner surface 9 of top section 2. Projection 8 has stiffly flexible characteristics and is directed toward a front of housing member H. Projection 8 includes a stepped area defining engaging surfaces 10 and 11. Projection 8 is movable as a unitary structure about the area connecting projection 8 to inner surface 9 which area comprises an area of flection. The width of projection 8 is equal to the spacing between inwardly directed sections 1.

Inwardly directed sections 1 and 4 comprise forward stop means to limit movement of an electrical terminal in one direction within housing member H and projection 8 comprises an inner or rear stop means to limit the movement of the electrical terminal in another direction within the housing member.

An electrical terminal T, which is preferably of the type disclosed in U.S. Pat. No. 2,774,951, is securable within housing member H by the forward and rear stop means. Electrical terminal T comprises a ferrule section 12 which is preferably secured to the conductive portion and insulation portion of conductor member 13 by conventional crimping techniques. The electrical terminal also includes a contact section 14 which comprises a floor portion 15 and curved side portions 16 which curve back over floor portion 15 and the free ends of side portions 16 terminate above floor portion 15 in spaced relationship therefrom as illustrated in FIG. 1. Floor portion 15 has a slot 15′ therein.

Figure 3:
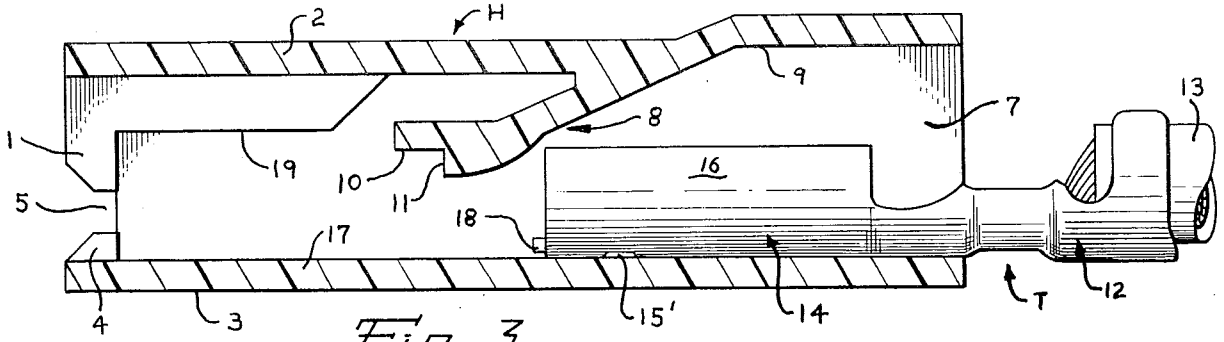
FIG. 3 is a view taken along lines 3—3 of FIG. 1 and with an electrical terminal about to be positioned therewithin.
Figure 4:
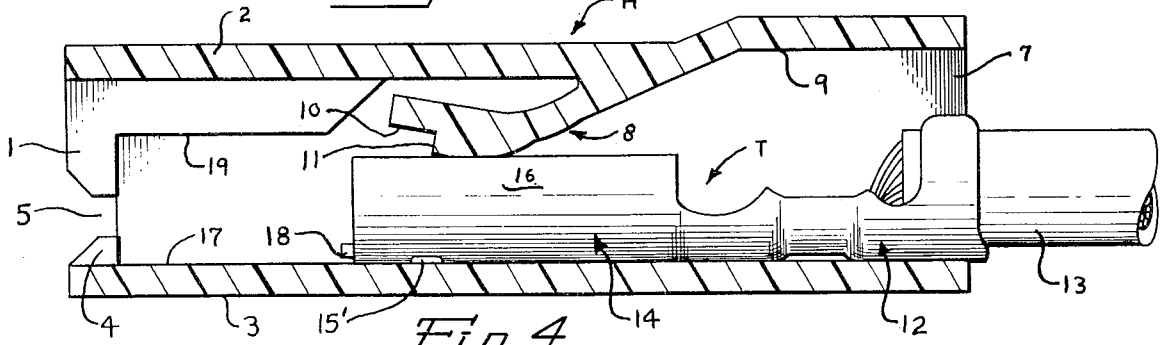
FIGS. 4 and 5 are views similar to FIG. 3 showing the electrical terminal partially inserted within the housing member and fully inserted within the housing member in a secured position therein.
Figure 5:
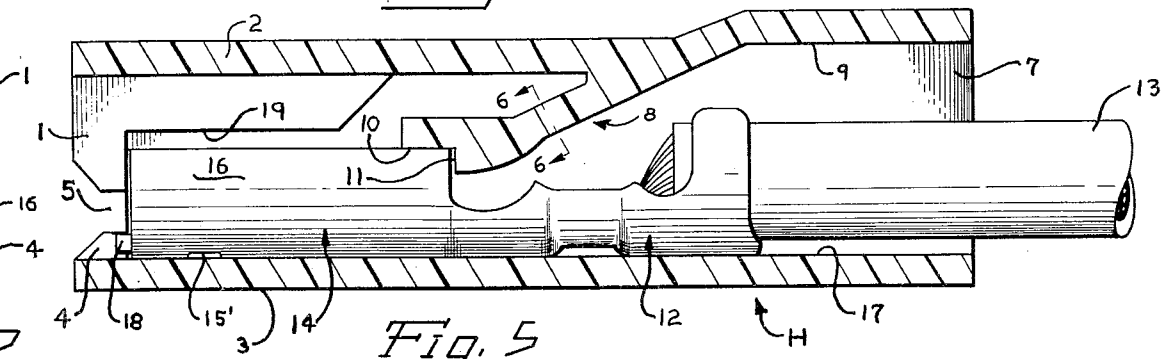
Figure 6:
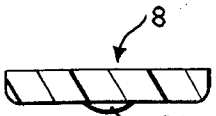
FIG. 6 is a view taken along lines 6—6 of FIG. 5.

In assembly, electrical terminal T is inserted within housing member H through the rear entrance as illustrated in FIG. 2. As the electrical terminal is moved along passageway 7, the tops of the side portions 16 engage projection 8 and move same as a unitary member about its flection area toward inner surface 9, as illustrated in FIG. 3. Electrical terminal T is moved further along passageway 7 until the forward end of the contact section engages the forward stop means comprising sections 1 and 4 and integral projection 8 moves back toward its normal position of rest as illustrated in FIG. 2 with engaging surface 10 engaging the tops of side portions 16 and engaging surface 11 is disposed adjacent the rear end of contact section 14 and illustrated in FIG. 4.

The resilient characteristics of projection 8 causes projection 8 to bias the electrical terminal towards surface 17 of bottom section 3. Thus, the forward and rear stop means of housing member H secure the electrical terminal in position within the housing member and the contact section in alignment with entrance 5 so that the electrical terminal can readily receive a mateable electrical terminal member within the contact section, the beveled surfaces of sections 1 and 4 facilitate the insertion of the electrical terminal member within entrance 5 and the contact section of electrical terminal T. Sections 4 are spaced closer together than sections 1 in order to accommodate an extension 18 which is part of a section that connected the electrical terminal to an adjacent electrical terminal in strip form.

With the electrical terminals secured in position within the housing member by the securing means, the terminal can withstand extremely high extraction forces on the terminal member since the force driving the inner end of the contact section against engaging surface 11 tends to move projection 8 in a direction away from surface 9, and, as the force increases, projection 8 bends about an area between the point of connection of projection 8 to surface 9 and the free end of the projection and the projection assumes an arcuate configuration with the free end being directed toward surface 9. This increases the retention force of the inner stop means. Surfaces 19 which have the same width as sections 1 and extend inwardly within passageway 7 and as part of side sections 6 and top section 2 limit the upper movement of the electrical terminal in its secured position within the housing member. A rounded projection 20 extends outwardly from the bottom surface of projection 8 adjacent engaging surface 11 and this projection serves to ride over slot 15′ to prevent engaging surface 11 from engaging the leading surface of the slot in the event that the electrical terminal is inserted within the housing member in an inverted position.

Figure 8:
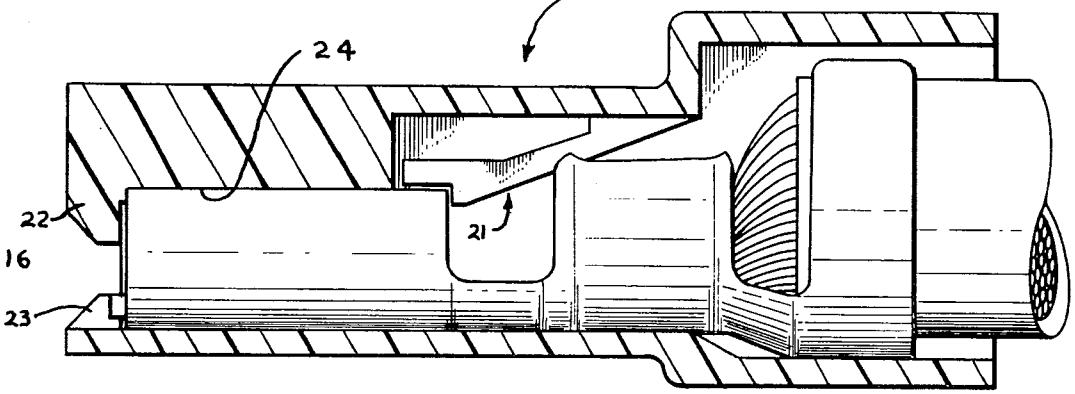
FIG. 8 is a view taken along lines 8—8 of FIG. 7.
Figure 7:
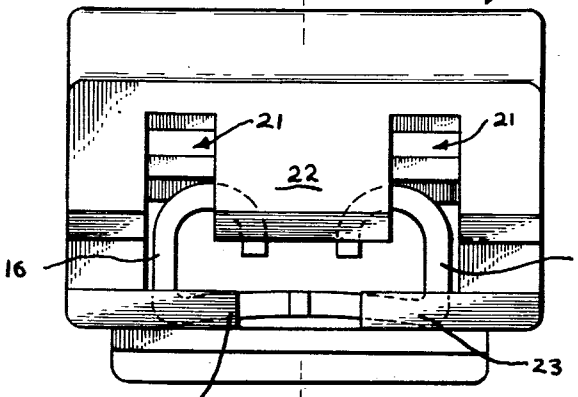
FIG. 7 is a front elevational view of an alternative embodiment of the housing member.

FIGS. 7 and 8 illustrate an alternative embodiment of the invention. In this embodiment, housing member H*a* is similar to the housing member of FIGS. 1 through 6 except that integral projections 21 are spaced from each other and are in alignment with the legs of a U-shaped opening in the front of the housing member as illustrated in FIG. 7. Projections 21 are similar to projection 8 and they operate in the same manner to engage respective side portions 16 of the electrical terminal. Centrally located and inwardly-directed section 22 and inwardly-directed sections 23 form the forward stop means of the housing member, and surface 24 limits the upper movement of the electrical terminal within the housing member. Projections 21 may be interconnected by a section extending therebetween and which terminates forward of the crimping ferrule. Housing member H*a* of FIGS. 7 and 8 is useful in conjunction with electrical terminals having a high crimp height which would not be usable in the embodiment of FIGS. 1 through 6.

Figure 10:
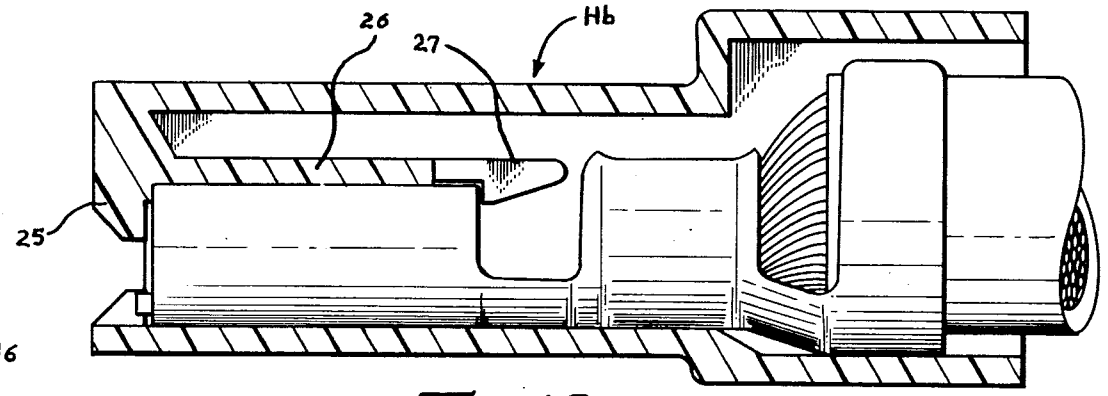
FIG. 10 is a view taken along lines 10—10 of FIG. 9.
Figure 9:
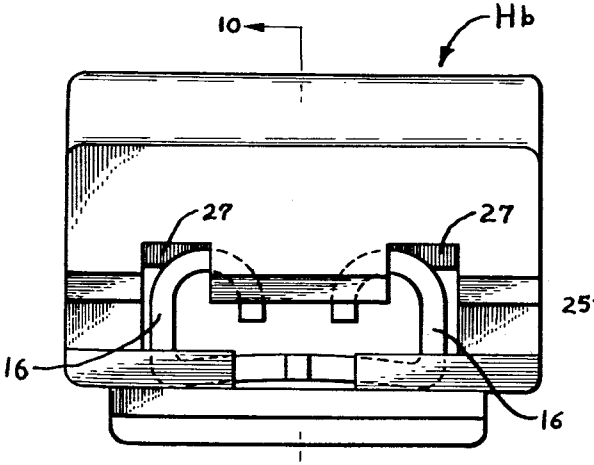
FIG. 9 is a front elevational view of a further embodiment of the housing member.
Figure 12:
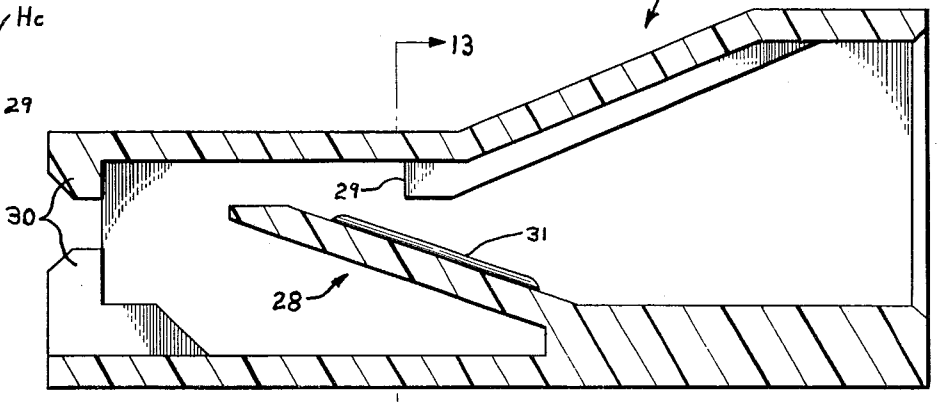
FIG. 12 is a view taken along lines 12—12 of FIG. 11.
Figure 14:
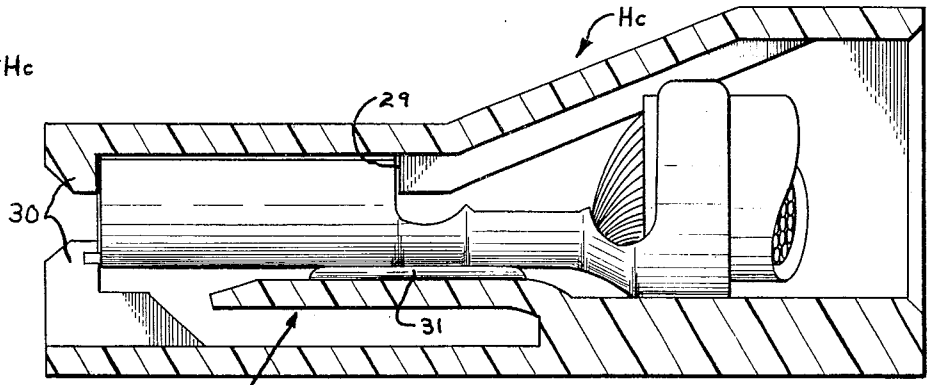
FIG. 14 is a view similar to FIG. 11 but showing an electrical terminal secured within the housing member.
Figure 11:
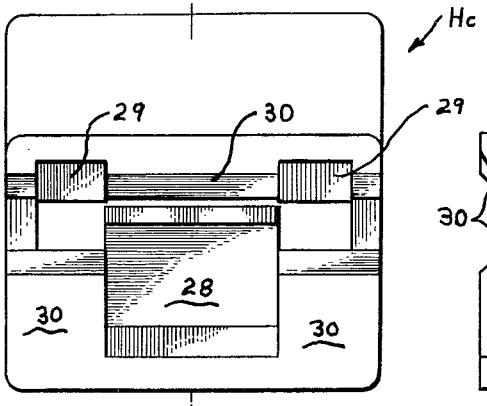
FIG. 11 is a front elevational view of an additional embodiment of the housing member.
Figure 13:
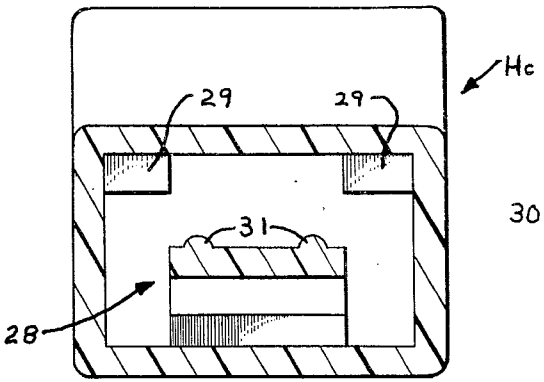
FIG. 13 is a view taken along lines 13—13 of FIG. 12.

FIGS. 9 and 10 are directed to a further embodiment of a housing member H*b* and this housing member is similar to the embodiment of FIGS. 7 and 8 except that centrally located and inwardly-directed section 25 includes a rearwardly-directed extension 26 engageable against the tops of side portions 16 of the electrical terminal to bias the electrical terminal in a direction toward the bottom surface of the passageway and stiffly-flexible hooks 27 engage the inner ends of side portions 16 and define the inner stop means.

FIGS. 11 through 14 illustrate a still further embodiment of the invention which illustrates a housing member H*c* comprising a stiffly-flexible integral projection 28 which biases the electrical terminal against the upper surface of the passageway and maintains the arcuate parts of side portion 16 of the electrical terminal into locking alignment with stop surfaces 29 which define the inner stop means. Inwardly-directed sections 30 form the forward stop means of housing member. Spaced projections 31 are located on the upper surface of projection 28 to decrease the frictional engagement between projection 28 and the bottom surface of the electrical terminal.

In order to remove the terminal from the housing member in the embodiment of FIGS. 1 through 6, a probe (not shown) is inserted within the housing member of entrance 5 to engage surface 10 and move projection 8 until surface 11 is clear of the inner end of the contact section, force supplied to conductor member 13 then permits the terminals to be removed from the housing member. Bifurcated probes would have to be used to free projections 21 and hook members 27 from engagement with the inner end of the contact section in the embodiments of FIGS. 7 and 8 and 9 and 10. A probe is disposed between space projections 31 to move projection 28 so that the inner end of the contact section of the terminal is moved free of surfaces 29 in the embodiment of FIGS. 11 through 14 to remove the terminal from the housing member.

Figure 15:
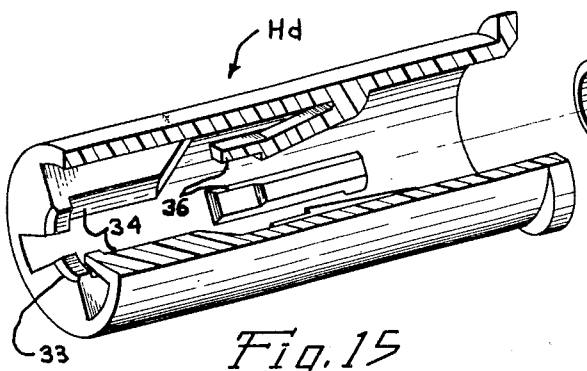
FIG. 15 is a perspective, partially-sectioned and exploded view of a still further embodiment of the housing member.
Figure 17:
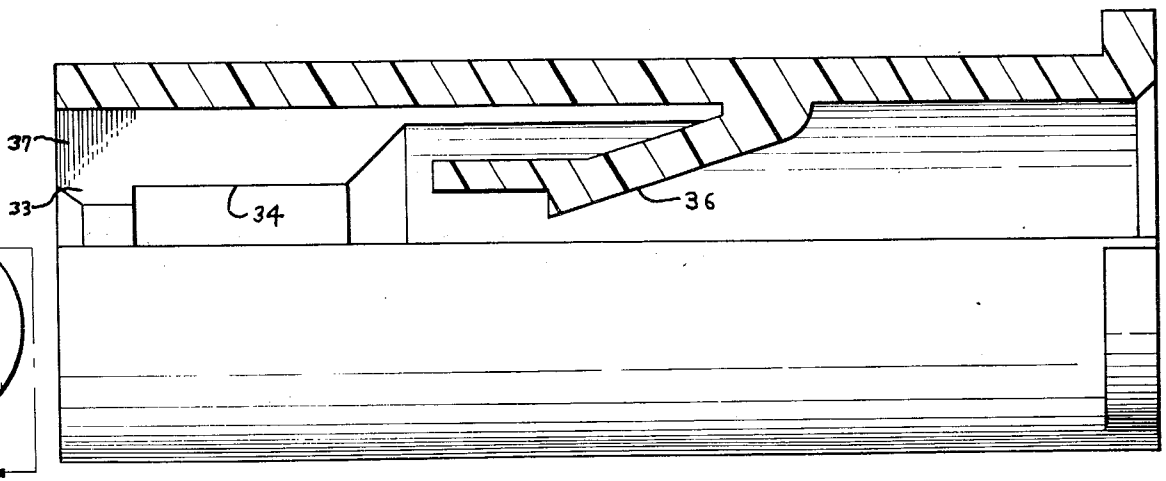
FIG. 17 is a view taken along lines 16—16 of FIG. 16.
Figure 16:
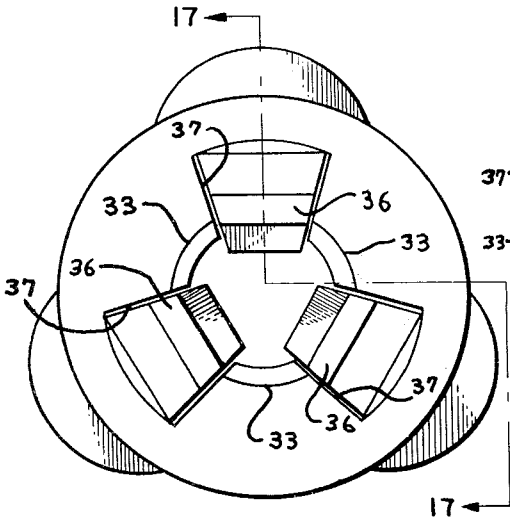
FIG. 16 is a front elevational view of the housing member of FIG. 15.

FIGS. 15–17 illustrate a still further embodiment of housing member H*d* which is to receive and secure therein a round socket terminal 32. Housing member H*d* has equally-spaced sections 33 at the front end which are the front stop means. Surfaces 34 extend rearwardly from sections 33 and these surfaces define a terminal-receiving area in which contact section 35 is disposed and maintained in alignment with the front entrance of the housing member. Spaced projections 36 are located in alignment with respective recesses 37 in the front end of the housing member and projections 36 operate in the same manner as projection 8, FIGS. 1–6, so that one of the projections engages the inner end of the contact section thereby obviating any orientation between the housing member and terminal. The angular distance between the projections is such that it is smaller than the engageable area above the ferrule member of the terminal.

The housing members may be provided with a plurality of passageways in accordance with the teaching of the invention to secure a plurality of electrical terminals therein.

It will, therefore, be appreciated that the aforementioned and other desirable objects have been achieved; however, it should be emphasized that the particular embodiments of the invention, which are shown and described herein, are intended as merely illustrative and not as restrictive of the invention.

What is claimed is:

1. An electrical connector assembly comprising a unitary dielectric housing of hard springy material and an electrical terminal, said housing having at least one passageway therein in which said electrical terminal is located, forward stop means formed integrally from said housing and extending partially across said passageway toward which one end of a contact section is directed to limit movement of the electrical terminal in one direction, at least one inner stop means formed integrally from said housing and extending along part of said passageway, said inner stop means directed toward the rear of said passageway and comprising a unitary stiffly-flexible member having cam means and latching means spaced apart therealong, said cam means adapted to be engaged by said terminal during insertion of said terminal in said passageway to move said latching means away from the path of insertion of said terminal to allow insertion of said terminal into said passageway and said latching means moving back toward the path of insertion of the terminal when the terminal is fully inserted into said passageway to engage a section of said terminal to limit movement of the electrical terminal in a direction opposite to the one direction.

2. For use in an electrical terminal assembly, a unitary dielectric housing made from hard spring material and having at least one passageway therein, said passageway being formed to accommodate a terminal member, a forward stop means formed integrally from said housing and extending partially across said passageway adjacent an entrance of said passageway to limit movement of the terminal member in one direction, at least one inner stop means formed integrally from a surface of said housing and defining a stiffly-flexible unitary member extending along a portion of said passageway and parallel with respect to opposed housing surfaces and including spaced hook members at a free end of said unitary member, said hook members having cam means and latching means spaced apart therealong, said unitary member being movable from a position of rest by engagement of the terminal member with said cam means to move said latching means away from the path of insertion of the terminal member to allow the terminal member to be inserted within said passageway and said unitary member being movable toward said position of rest with said latching means in engagement with the terminal member when the terminal member is fully inserted into the passageway to limit movement of the terminal member in another direction opposite from said one direction.

* * * * *